US006039546A

United States Patent [19]

Edwards et al.

[11] Patent Number: 6,039,546

[45] Date of Patent: Mar. 21, 2000

[54] FLOAT OPERATED PNEUMATIC PUMP TO SEPARATE HYDROCARBON FROM WATER

[75] Inventors: David H. Edwards, Ann Arbor; Kevin L. Newcomer, Monroe; K. Lynn Niehaus, Manchester, all of Mich.

[73] Assignee: QED Environmental Systems, Inc., Ann Arbor, Mich.

[21] Appl. No.: 08/939,775

[22] Filed: Sep. 29, 1997

Related U.S. Application Data

[63] Continuation-in-part of application No. 08/721,866, Sep. 27, 1996, abandoned.

[51] Int. Cl.[7] ..... F04B 53/00; F04F 1/06

[52] U.S. Cl. ..... 417/61; 417/131; 166/105

[58] Field of Search ..... 417/61, 116, 118, 417/126, 130, 131, 134, 138; 166/54, 105

[56] References Cited

U.S. PATENT DOCUMENTS

| | | |
|---|---|---|
| 1,439,591 | 12/1922 | Welden . |
| 2,141,261 | 12/1938 | Clark . |
| 2,606,500 | 8/1952 | Schmidt . |
| 3,007,416 | 11/1961 | Childs . |
| 3,039,309 | 6/1962 | Vesper et al. . |
| 3,048,121 | 8/1962 | Sheesley . |
| 3,074,351 | 1/1963 | Foster . |
| 3,148,624 | 9/1964 | Baldwin . |
| 3,154,021 | 10/1964 | Vick, Jr. . |
| 3,173,372 | 3/1965 | Baldwin . |
| 3,175,498 | 3/1965 | Rohrer . |
| 3,194,170 | 7/1965 | Ulbing . |
| 3,298,320 | 1/1967 | Latham, Jr. . |
| 3,647,319 | 3/1972 | McLean et al. . |
| 3,677,667 | 7/1972 | Morrison . |
| 3,724,973 | 4/1973 | Shill . |
| 3,816,032 | 6/1974 | Flynn et al. . |
| 3,949,753 | 4/1976 | Dockhorn . |
| 3,983,857 | 10/1976 | O'Conner . |
| 3,987,775 | 10/1976 | O'Conner . |
| 4,020,978 | 5/1977 | Szczepanski . |

(List continued on next page.)

*Primary Examiner*—Charles G. Freay
*Attorney, Agent, or Firm*—Harness, Dickey & Pierce, PLC

[57] ABSTRACT

A float operated pneumatic pump which separates water from hydrocarbons within a well at the pump in accordance with the density or specific gravity of the water and hydrocarbon fluid. The pump includes a displaceable fluid inlet for allowing fluid to enter the pump which generally tracks the level of the water/hydrocarbon interface. The pump includes an outer tube forming an outer chamber and an inner or dip tube placed within the outer chamber of the outer tube and forming an inner chamber. A well float includes the fluid inlet and has a density which enable the float to remain in proximity to the water/hydrocarbon interface. A tubular coil or conduit provides fluid passage between the fluid inlet and the outer chamber. Also, a fluid separator is located at the bottom end of the outer tube and defines a fluid passage between the inner and outer chambers. In one configuration, the separator allows water to exit the pump from the outer chamber while the hydrocarbons remain within the outer chamber. In a second configuration, the separator prevents water from entering the pump and enables hydrocarbons to be discharged from the pump. In an alternative embodiment a single piece intake manifold is used which has a fixed fluid inlet. This permits the overall pump to be made significantly less in length to permit the pumping of shallower amounts of fluids from within a well.

24 Claims, 9 Drawing Sheets

U.S. PATENT DOCUMENTS

| | | |
|---|---|---|
| 4,030,640 | 6/1977 | Citrin et al. . |
| 4,092,087 | 5/1978 | Anthony et al. . |
| 4,104,005 | 8/1978 | Poirier . |
| 4,184,811 | 1/1980 | Schade . |
| 4,257,751 | 3/1981 | Kofahl . |
| 4,295,801 | 10/1981 | Bennett . |
| 4,438,654 | 3/1984 | Torstensson . |
| 4,489,779 | 12/1984 | Dickinson et al. . |
| 4,580,952 | 4/1986 | Eberle . |
| 4,585,060 | 4/1986 | Bernardin et al. . |
| 4,603,735 | 8/1986 | Black . |
| 4,669,554 | 6/1987 | Cordy . |
| 4,701,107 | 10/1987 | Dickinson et al. . |
| 4,727,936 | 3/1988 | Mioduszewski et al. . |
| 4,807,707 | 2/1989 | Handley et al. . |
| 4,886,432 | 12/1989 | Kimberlin . |
| 4,974,674 | 12/1990 | Wells . |
| 4,998,585 | 3/1991 | Newcomer et al. . |
| 5,004,405 | 4/1991 | Breslin . |
| 5,033,550 | 7/1991 | Johnson et al. . |
| 5,131,466 | 7/1992 | Chacin U. et al. . |
| 5,141,404 | 8/1992 | Newcomer et al. . |
| 5,147,184 | 9/1992 | Newcomer et al. . |
| 5,147,185 | 9/1992 | Niehaus et al. . |
| 5,161,956 | 11/1992 | Fiedler . |
| 5,358,038 | 10/1994 | Edwards et al. ..... 166/105 |

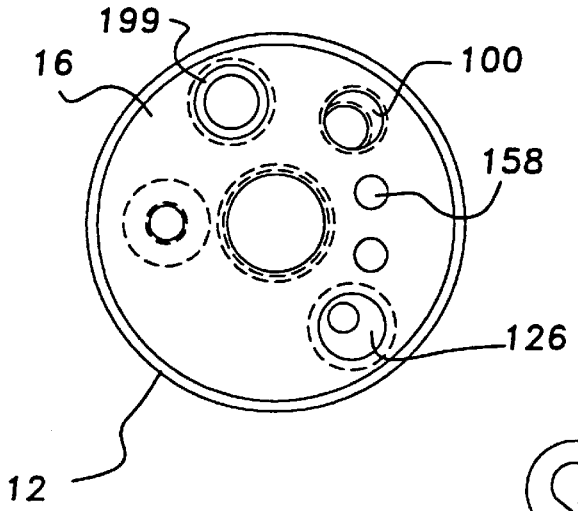
Fig-7
Fig-10
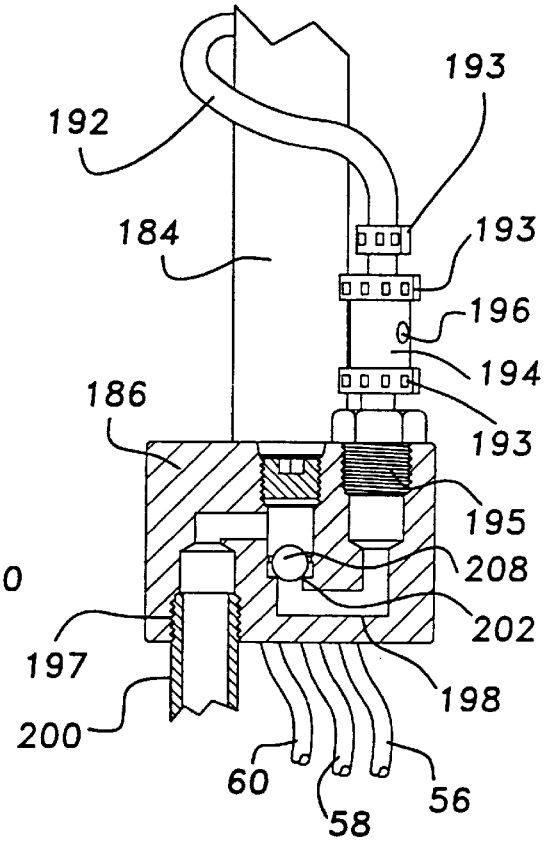
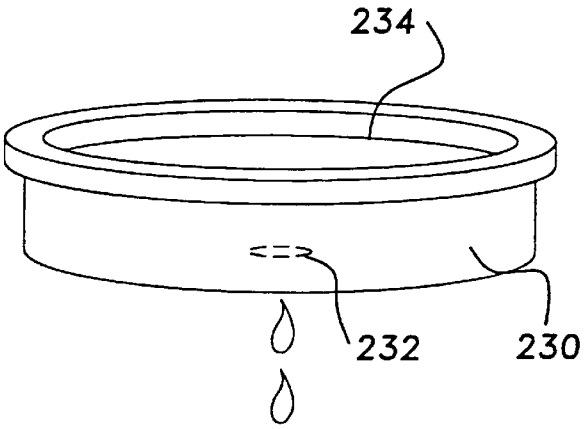
Fig-11
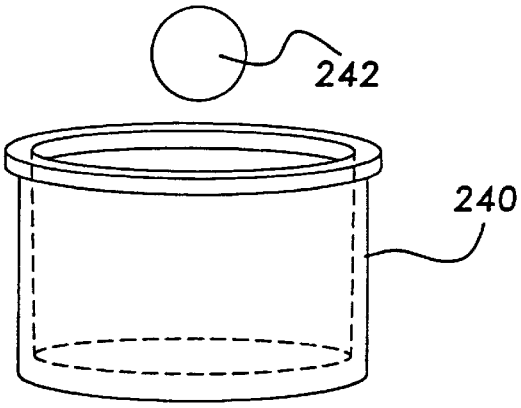
Fig-12

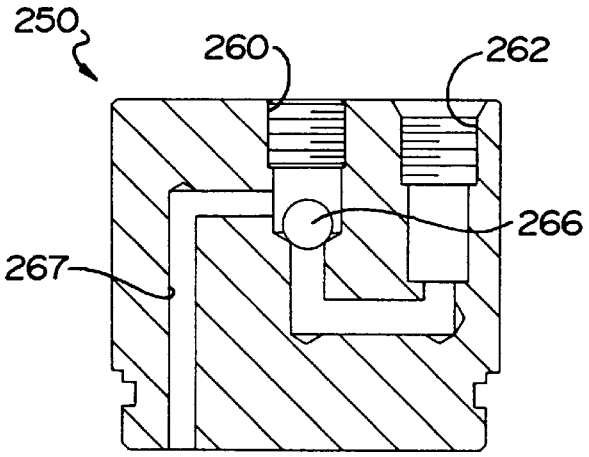
Fig-16
Fig-17
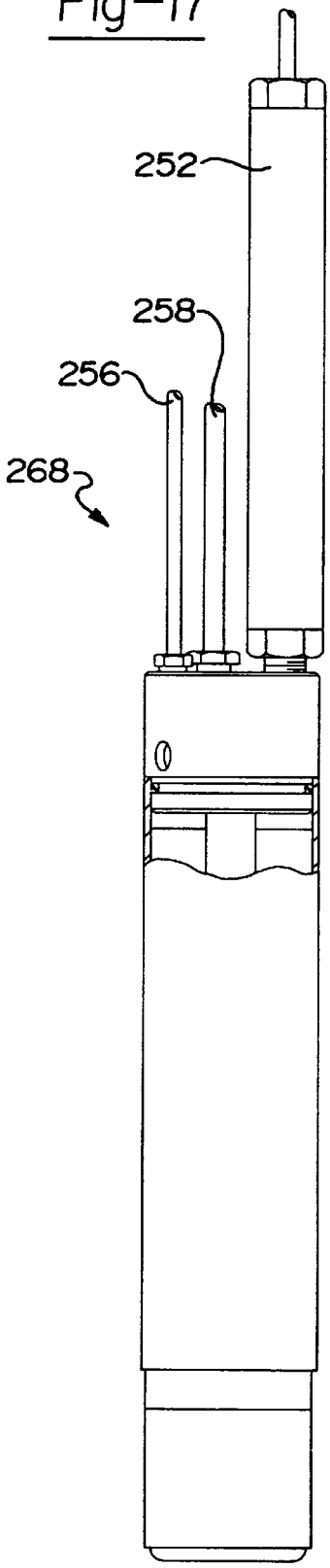

FLOAT OPERATED PNEUMATIC PUMP TO SEPARATE HYDROCARBON FROM WATER

CROSS-REFERENCE TO RELATED APPLICATIONS

This application is a continuation-in-part of U.S. application Ser. No. 08/721,866, filed Sep. 27, 1996, now abandoned, entitled "Float Operated Pneumatic Pump To Separate Hydrocarbon From Water", presently pending.

FIELD OF THE INVENTION

The present invention relates generally to underground fluid pumping systems. More particularly, the present invention relates to underground fluid pumping systems which separate water and hydrocarbons so that only the hydrocarbons are removed from the well and which has an inlet which remains near the hydrocarbon/water interface to maximize the hydrocarbons removed while minimizing water removed from the well.

BACKGROUND OF THE INVENTION

Increased monitoring of environmental quality has resulted in a substantial rise in the number of identified sites of contaminated ground water. Accompanying this trend has been an increased effort to clean up these sites. In response, there is a need for improved below ground pumping systems to assist in these clean up efforts.

Ideally, below ground pumping systems used for these purposes will have a number of desired characteristics. Because of the large number of pumping systems required, it is desirable to minimize the cost of each pump and each installation. Accordingly, such pumps should be relatively simple and inexpensive and should fit in a small diameter well due to the increased cost of drilling large diameter wells. To minimize maintenance and repair costs, the pumps should have a minimum of moving parts and should have high reliability. Also, such pumps should be able to withstand corrosive fluid streams without failure.

Due to the possibility of exposure of the pumping systems to explosive gasses, pneumatic pumps are preferred over electrical pumps for pumping waste products. However, many of the currently used pneumatic pumps have a number of drawbacks. For example, many pumps in current use require external controlling devices which use timers to activate the pump on a fixed schedule. This necessity of external controllers adds considerably to the cost and complexity of the overall pumping system. In addition, the use of a fixed time pumping schedule has disadvantages since it may not result in pumping at the most opportune time to obtain the maximum production from the pump. For example, an external timer cannot sense variations in the flow rate of fluid into the pump and thus may result in either a too fast or a too slow pumping cycle.

There are pumps which avoid the necessity of external controllers by incorporating sensing means within the pump to detect when fluid has entered the pump to a desired level. Unfortunately, the prior art pumps which are capable of self activation have not proved satisfactory in many applications. One problem has been with the mechanical actuating and sensing mechanism within the pumps. Generally, such pumps use a float which rises when the pump fills and lowers when the pump is empty. Actuating mechanisms which sense the movement of this float sometimes require considerable force to switch the pneumatic valve of the pump on and off. This results in the necessity of a fairly large and heavy float which increases the overall size and cost of the pump system.

In addition to the problems with the actuating mechanism, the pneumatic valve or valves used to control the flow of compressed air into these pumps have often proved unreliable. Spool type valves incorporating sliding seals are often used in prior art pumps of this nature. The force necessary to move these sliding seals to actuate spool type valves are one source of the excess actuating force requiring the above mentioned large and heavy floats. In addition, spool type valves result in high maintenance and repair costs due to their tendency to freeze or to leak. There are a number of causes of the difficulties with sliding seals. These include debris entering the seals from the source of compressed air; contamination of the seals from the liquid being pumped (especially where highly corrosive waste products are pumped); loss of lubrication in the seals; and compression set of the elastomeric seals if they remain inactive for an extended period of time. In addition, some prior art pumps employ valves which have a significant cross over point where air supply is partially open and air exhaust is partially closed. At this point, the pump will tend to use a large amount of compressed air in an effort to switch to a fully open or a fully closed position. In some cases, the pump may reach a steady state condition with the head pressure in the surrounding well causing the pump to remain in a cross over, or all ports open, position.

Another difficulty with sliding seals results from the desire to provide a detent action between the discharge and refill cycles of the valve. As the sliding seals wear, the ability of these sliding seals to provide a detent action will be lost. The sliding seals are normally comprised of O-rings and the wear of these O-rings will result in short and erratic pump cycles unless the O-rings are replaced. Many of the above discussed requirements are met by the pumping systems shown in U.S. Pat. No. 5,358,038, issued Oct. 25, 1994, assigned to the assignee of the present invention and incorporated by reference herein.

Existing prior art pumps merely discharge the fluid which has filled the pump. This necessitates that existing prior art pumps be installed to a predetermined depth so that a fluid inlet is placed so that substantially only hydrocarbons enter the pump. The hydrocarbons enter the pump through the fluid inlet and may be eventually discharged from the pump.

Fixing the fluid inlet or the pump may result in satisfactory operation for relatively constant and stable water/hydrocarbon interface levels. Many water/hydrocarbon interface levels, however, change almost continuously. For example, rain, dry-spells, and tidal flow each affect the groundwater levels and the water/hydrocarbon interface as a result. Changes in the water/hydrocarbon interface levels result in ineffective operation of the pump. When the interface rises, the inlet becomes submerged in water so that the pump only discharges water. When the interface level drops. The fluid level may drop below the fluid inlet of the pump so that the pump does not remove any hydrocarbons from the well.

Another disadvantage of prior art pumps is that when the water/hydrocarbon interface does change relative to the pump's fluid inlet, the pump may take in water. Discharging the water from the pump by activating the pump results in inefficient operation of the pump. Thus, there is a strong desire to maximize the amount of hydrocarbons removed from the well, while minimizing the water removed from the well. One approach to maximizing removal of hydrocarbons and minimizing removal of water uses hydrophobic screens which allow entry of hydrocarbons into the pump and inhibit entry of water into the pump. Hydrophobic screens are susceptible to fouling and clogging which slows or stops hydrocarbon flow into the pump, adversely affecting the removal process. In addition, hydrophobic screens operate by wicking hydrocarbons into the pump. Such wicking proves ineffective when attempting to remove the surface sheen of hydrocarbon remaining on the water when almost all hydrocarbon has been removed. The hydrophobic screens fail to provide mass fluid flow required to clean up the last remnants of hydrocarbon found in the well.

In order to collect the final remnants of hydrocarbons in the well, some existing pumps have inlets that float at the interface of the water/hydrocarbon interface. These pumps, however, may introduce a substantial volume of water into the pump. Existing prior art pumps do not presently separate water and hydrocarbons that have entered the pump. Such pumps, thus, operate relatively inefficiently because a substantial amount of water may be pumped out of the well with any remnants of hydrocarbon. Thus, it is desirable to provide an underground pumping system which overcomes the above mentioned difficulties.

Accordingly, it is an object of the present invention to provide a simple and inexpensive pumping system for installing in small diameter wells. It is a further object of the present invention to provide such a pumping system which is reliable, has a limited number of moving parts and which provides automatic on/off level control to eliminate the need for external controllers.

It is a further object of the present invention to provide an underground pumping system which may be easily installed and operates automatically in order to achieve efficient use of air only when needed.

It is an additional object of the present invention to provide an underground pumping system which uses a pneumatic valve that avoids the use of sliding seals and which is switched between refill and discharge cycles with a minimum of actuation force and minimum of cross over.

It is a further object for the present invention to provide such a pumping system having a reliable and durable detent between pump discharge and refill cycles.

It is yet a further object of the invention to provide an underground pumping system having a fluid inlet which tracks the water/hydrocarbon interface so that primarily only hydrocarbons enter the pump.

It is yet a further object of the invention to provide a pumping system which separates water and hydrocarbon at the pump so that primarily only hydrocarbons are pumped from the well.

It is yet a further object of the invention to provide a pumping system which takes in water and hydrocarbon along the water/hydrocarbon interface and separates the water and hydrocarbons at the pump so that only hydrocarbons are pumped to the surface.

SUMMARY OF THE INVENTION

The preferred embodiments of the present invention relate to a pneumatic pump which separates a first and second fluid within a well containing the first and second fluids, each fluid having a specific gravity. The specific gravity of the second fluid is less than the specific gravity of the first fluid. The pneumatic pump includes an outer tube forming an outer chamber therein and an inner tube forming an inner chamber therein, where the inner tube is disposed within the outer chamber of the outer tube. In one preferred embodiment a well float is associated with the pump and has a fluid inlet. The well float has a specific gravity such that it floats in both the first and second fluids and that the inlet remains in proximity to the interface between the first and second fluids. The fluid inlet receives at least one of the first and second fluids. A conduit provides fluid passage between the fluid inlet and the outer chamber. A fluid separator is located at the lower end of the outer tube and defines a fluid passage between the inner and outer chambers so that in a first configuration, the first fluid exits the pump from the outer chamber while the second fluid remains within the outer chamber, and in a second configuration, the first fluid is sealed from entering the pump from an area exterior to the pump and the second fluid may be discharged from the pump. A discharge housing is disposed at the top end of the outer tube and has formed therein inlet and outlet air passages which cooperate to enable entry of fluid into the outer chamber and discharge of fluid from the outer chamber via the inner chamber. The discharge housing also has a fluid passage to communicate fluid from the inner chamber of the pump.

In an alternative preferred embodiment the invention incorporates a fixed fluid inlet. The inlet is positioned at or near the interface of the two fluids. A one-piece intake manifold assembly is also disclosed.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention:

FIG. 7 is a top view of the pumping system shown in FIG. 1 showing the relative location of the connection to the pumping system;

FIG. 10 is an enlarged cross-sectional view of the inlet manifold of FIG. 9;

FIG. 11 is a perspective view of a viscosity tester used to test the viscosity of hydrocarbons in the well in which the pumping system of FIG. 1 will be used;

FIG. 12 is a perspective view of a specific gravity tester used to test the specific gravity of hydrocarbons in the well in which the pumping system of FIG. 1 will be used;

FIG. 16 is a side cross sectional view of the intake flow path within the intake manifold; and FIG. 17 is a side, partial cross-sectional view of a pump having the manifold of FIGS. 13–16 attached thereto.

DETAILED DESCRIPTION OF THE PREFERRED EMBODIMENT

Figure 1:
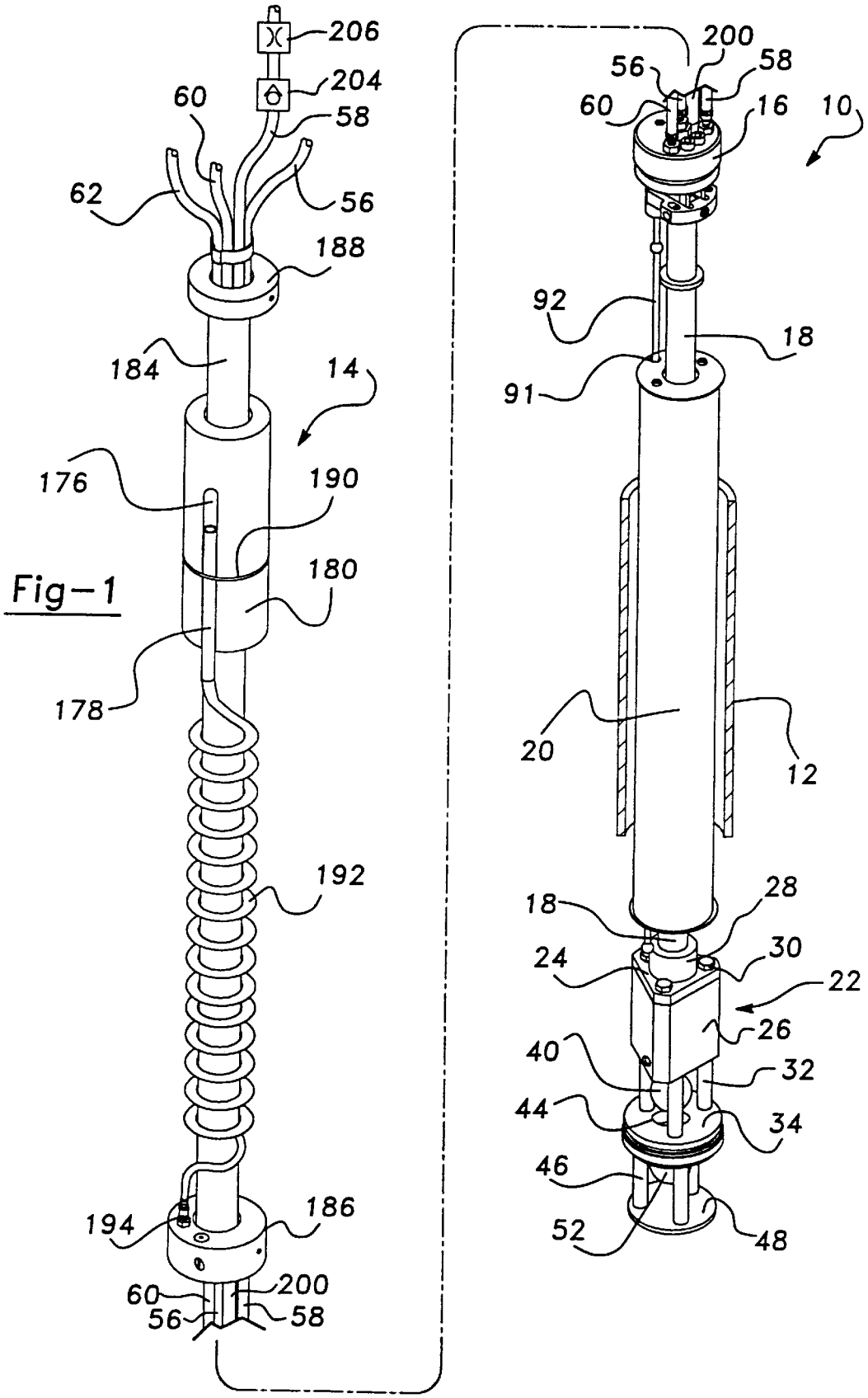
FIG. 1 is a longitudinal view of the pumping system arranged in accordance with the principles of the present invention.

Referring now to the drawings in which like reference numerals designate like or corresponding parts throughout the several views, there is shown in FIGS. 1 through 8 a pumping system 10 in accordance with the present invention. Pumping system 10 comprises a hollow pump body 12, an inlet mechanism 14, a discharge housing 16, a dip tube 18, a float 20, and a separator mechanism 22.

Figures 2, 9:
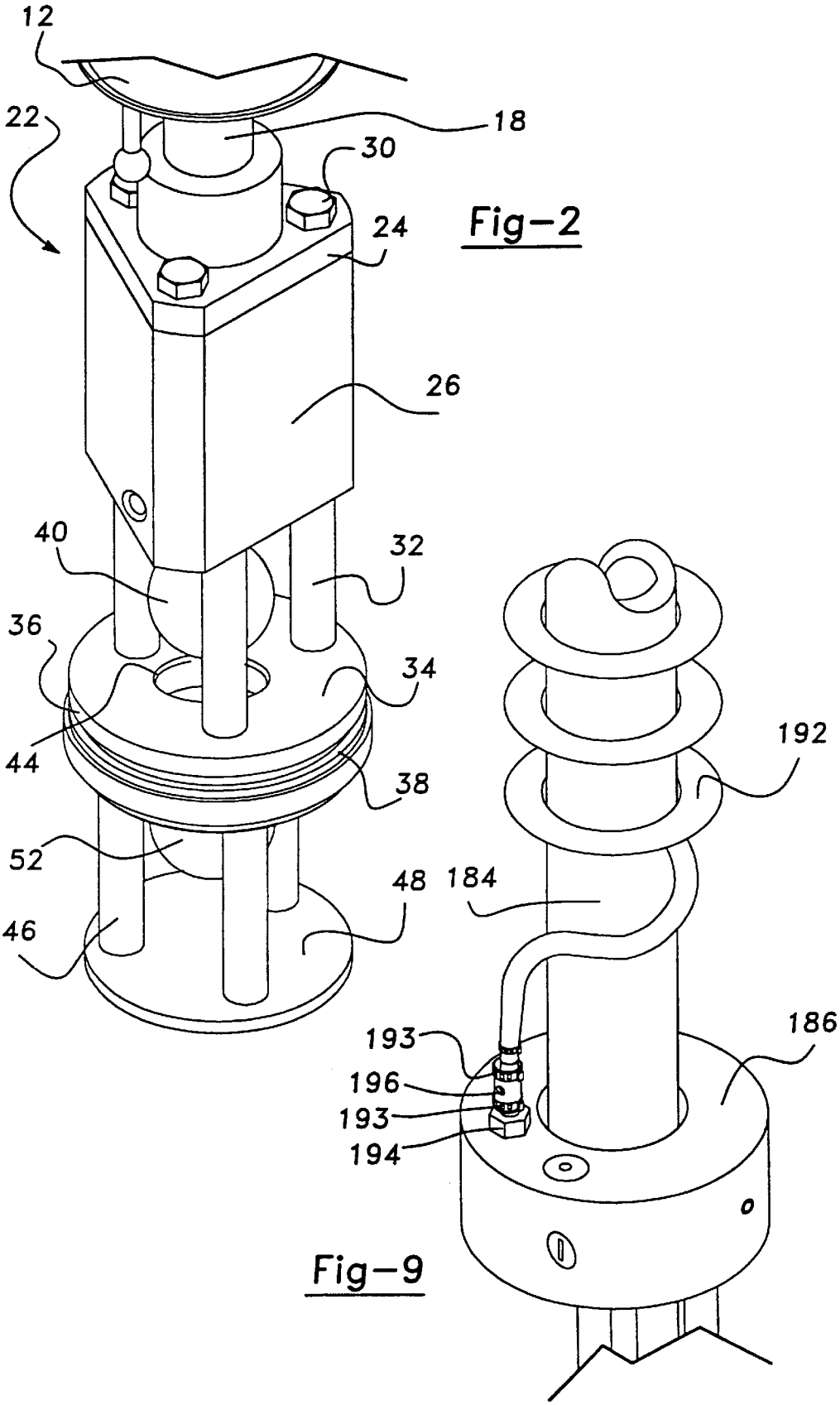
FIG. 2 is an enlarged view of the separator mechanism of the pumping system shown in FIG. 1.
FIG. 9 is an enlarged view of the inlet manifold and float guide of FIG. 1.
Figure 3:
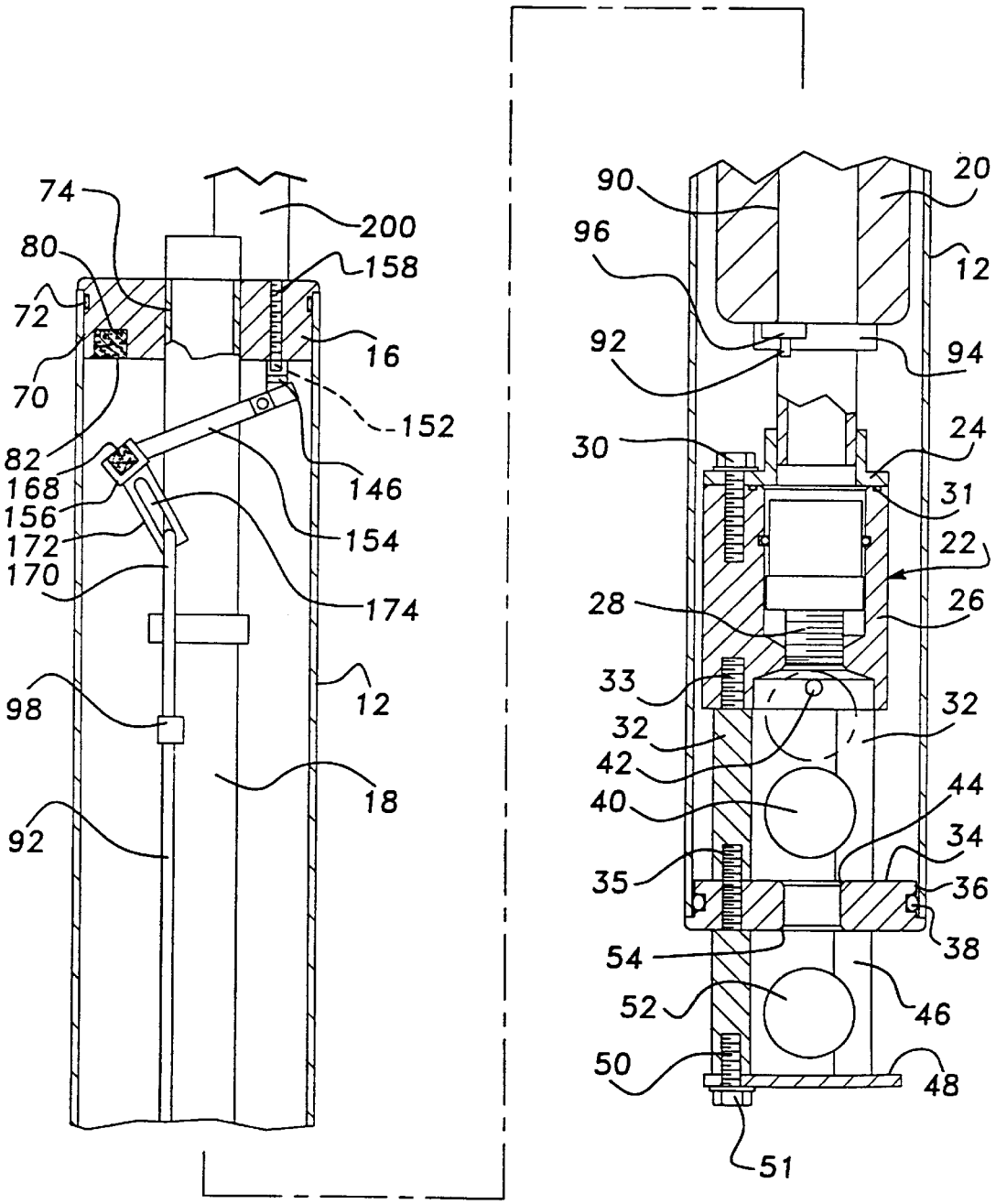
FIG. 3 is a longitudinal cross-sectional view of the pumping system of FIG. 1 shown in the refill cycle.
Figure 5:
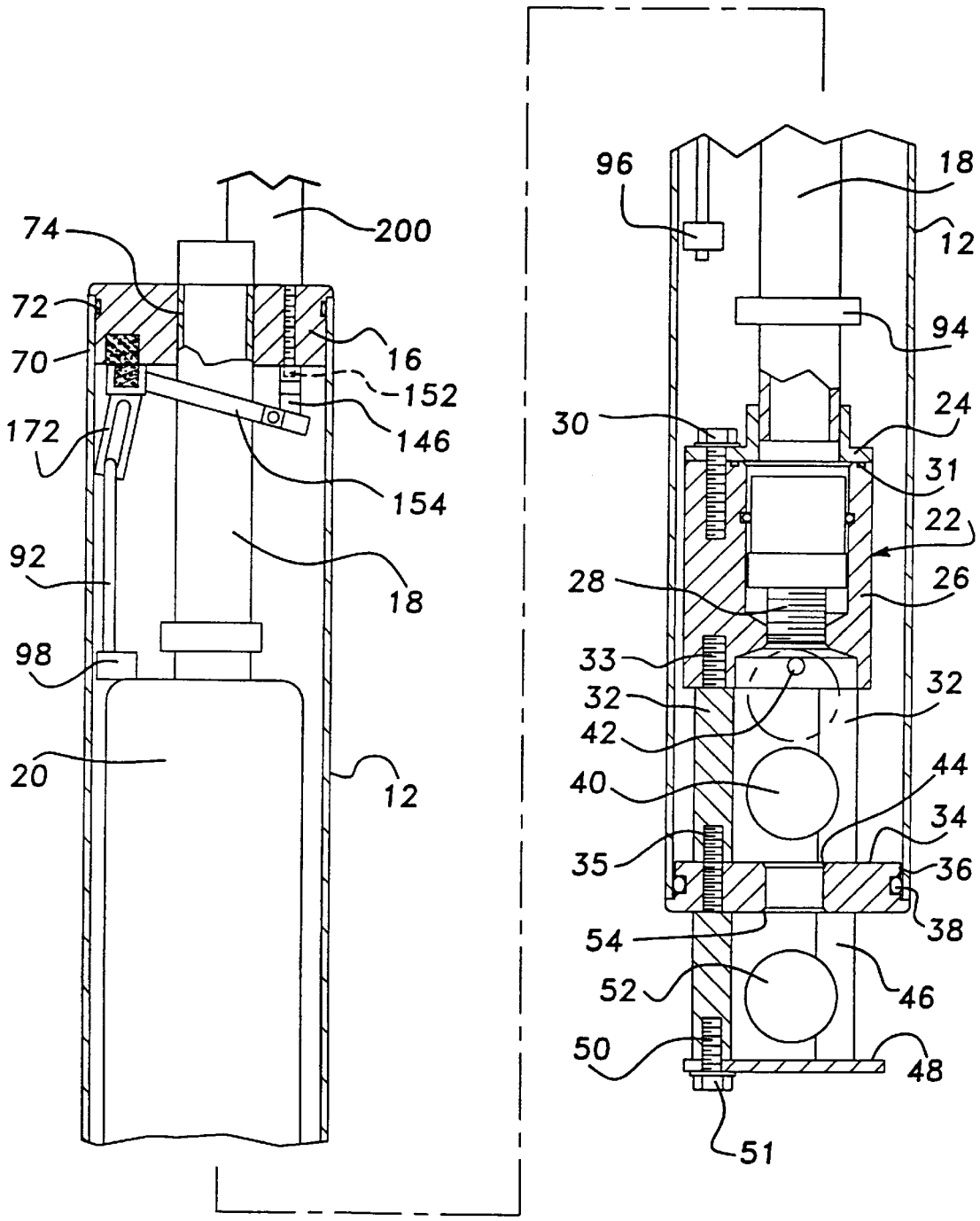
FIG. 5 is a longitudinal cross-sectional view of the pumping system in accordance with the present invention generally in the discharge cycle.

Pump body 12 is a cylindrical hollow tube preferably composed of a rigid material not susceptible to corrosion, such as stainless steel. As best seen in FIGS. 2, 3, and 5, pump body 12 is closed at its lower end by the separator mechanism 22 which is inserted into the lower end of pump body 12. Separator mechanism 22 includes a coverplate 24 which attaches to a check housing 26 via a plurality of screws 30 which fasten the coverplate 24 to the check housing 26. A spring loaded check valve 28 is threadably inserted into the top section of check housing 26 prior to fastening coverplate 24. An O-ring seal 31 provides an air and liquid seal between coverplate 24 and check housing 26.

A trio of legs 32 engage threads 33 formed in the bottom of check housing 26. At their other end, the legs 32 have a threaded interior portion. The legs 32 attach to bottom discharge plate 34 and are secured thereto by a trio of screws 35 which engage threads formed in the bottom section of the respective legs 32. Bottom discharge plate 34 includes a reduced diameter section 36 for insertion into pump body 12 and includes a seal 38 to form a liquid tight seal between bottom discharge plate 34 and pump body 12. The trio of legs 32 defines a cage for retaining upper check ball 40, which moves generally vertically in the cage. Upper check ball 40 preferably has a specific gravity less than water and greater than the fluid to be separated by the pumping system 10. A pin 42 prevents upper check ball 40 from seating in an upward direction. Similarly, bottom discharge plate 34 defines a valve seat 44 for upper check ball 40 when the pumping system 10 is discharging hydrocarbons from the pump.

A second trio of legs 46 engage threads (similarly as shown with respect to threads 33) formed in the lower section of bottom discharge plate 34. The legs 46 are fastened to bottom plate 48 by a trio of screws 51 which threadably insert into threads 50 formed in the lower sections of legs 46. Legs 46 define a cage for a lower check ball 52 which moves generally vertically within the trio of legs 46. Lower check ball 52 preferably has a specific gravity less than water. The lower section of bottom discharge plate 34 defines a valve seat 54 which receives lower check ball 52 when all water has been expelled from the pumping system 10.

As best seen in FIGS. 3–6, at the opposite end of pump body 12 is discharge housing 16 which has a reduced diameter portion 70 for inserting it into pump body 12. A seal 72 forms a liquid and air tight seal with pump body 12. Discharge housing 16 includes a liquid discharge port 74 which extends through discharge housing 16 and is adapted for mating with dip tube 18 as will be described later herein. Discharge housing 16 has integrally formed therein an air inlet port 76, an air discharge port 78 and a bore 80 (FIGS. 3 and 5) for locating a first actuating magnet 82. Air inlet port 76 is adapted to include an air inlet mechanism, and air discharge port 78 is adapted to include an air discharge valve mechanism as will be described later herein.

Dip tube 18 extends from discharge port 74 of discharge housing 16 to coverplate 24 of separator mechanism 22. Dip tube 18 is sealingly secured to both discharge housing 16 and coverplate 24 by threads, welds, or other means known well in the art. Dip tube 18 provides a path for the fluid within pump body 12 to flow out of pump body 12 through dip tube 18 and through discharge port 74. Discharge port 74 communicates fluid to both dip tube 18 and then to discharge tube 56 for transporting the pumped fluid to the surface.

Float 20 is disposed within the interior of pump body 12 and defines an axial bore 90 into which dip tube 18 is inserted. There is sufficient clearance between axial bore 90 and the exterior of dip tube 18 to permit float 20 to freely move up and down along dip tube 18. Float 20 further defines a second axial bore 91 into which an actuating rod 92 is inserted. Actuating rod 92 is positioned substantially parallel to dip tube 18, and there is sufficient clearance between the second axial bore 91 in the float 20 and the exterior of actuating rod 92 to permit float 20 to freely move up and down along actuating rod 92. A lower stop 94 is fixedly secured to dip tube 18 and is positioned towards the lower end of actuating rod 92 to limit the downward movement of float 20. A second lower stop 96 is fixedly secured to actuating rod 92 and is positioned towards the lower end of actuating rod 92 in order for the weight of float 20 to be able to deactivate the pumping of pumping system 10. An upper stop 98 is fixedly secured to actuating rod 92 and is positioned towards the upper end of actuating rod 92 to limit the upward movement of float 20. Float 20 is less dense than the liquid to be pumped and thus provides sufficient lifting action when pump body 12 is filled with fluid to activate pumping system 10 as will be explained later herein. Float 20 also provides sufficient weight to deactivate the pumping of pumping system 10 as will also be explained later herein.

Figure 4:
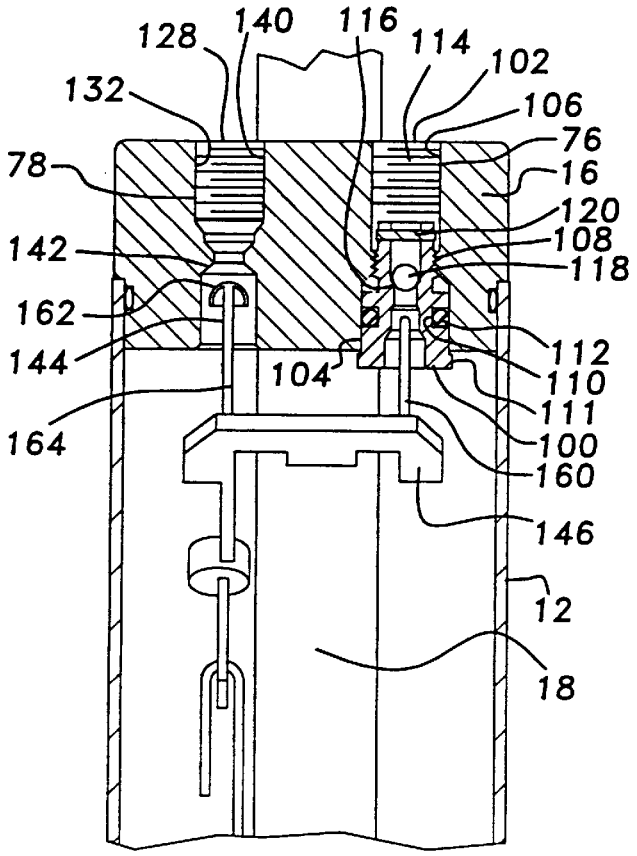
FIG. 4 is an enlarged cross-sectional view of the inlet and exhaust valves of the pumping system shown in FIG. 1 generally in the refill mode.
Figure 6:
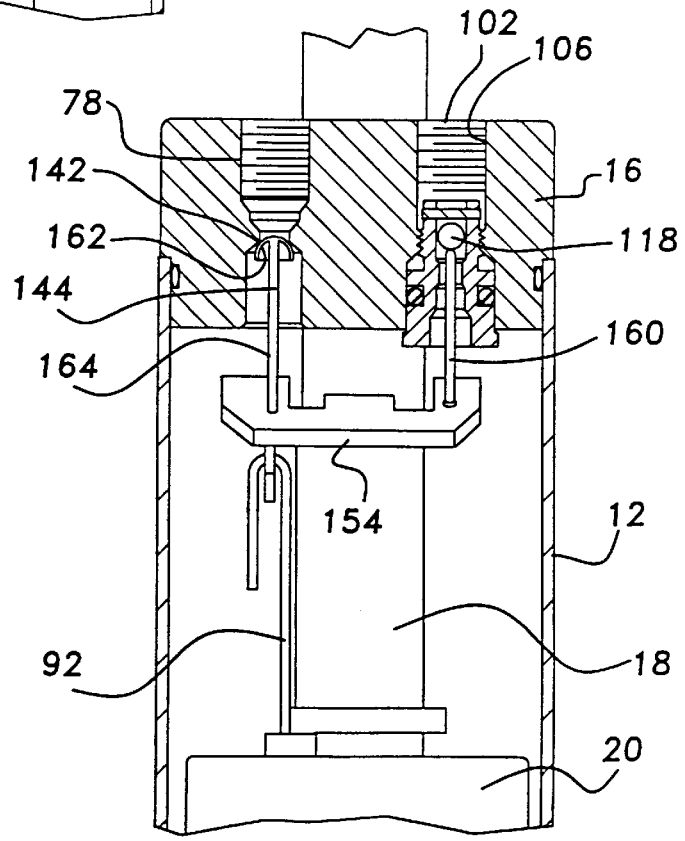
FIG. 6 is an enlarged cross-sectional view of the inlet and exhaust valves of the pumping system shown in FIG. 5 in the discharge mode.

Air inlet port 76 includes a generally cylindrical shaped passage 102 defining an internal surface 106, as best seen in FIGS. 4 and 6. Air inlet valve 100 is generally cylindrically shaped and is threadably inserted into a bore 104 formed in the bottom of passage 102 by engaging threads 108. An annular groove 110 is defined by the outer surface of air inlet valve 100 and receives a seal 112 for sealing the connection between air inlet valve 100 and discharge housing 16. Seal 112 provides a liquid/air seal between air inlet valve 100 and discharge housing 160. The axial position of air inlet valve 100 is adjusted by threading air inlet valve 100 to vary the engagement of threads 108. A hex nut 111 facilitates turning of an air inlet valve 100. Seal 112 also assists in maintaining the axial position of inlet valve 100. Internal surface 106 defines a threaded end 114 for connection to air supply tube 58 which supplies the compressed air to pumping system 10 for activation. Air inlet valve 100 forms an inlet valve seat 116. A ball 118 is positioned between threaded end 114 and inlet valve seat 116. Ball 118 cooperates with inlet valve seat 116 to connect and disconnect the compressed air being supplied to air inlet valve 100 with the interior of pump body 12. A retaining pin 120 is provided to maintain ball 118 within air inlet valve 100. While air inlet port 76 has been shown and described as being an integral component of discharge housing 16, it is within the scope of the present invention to have individual components define inlet port 76, as is shown in U.S. Pat. No. 5,358,038, already incorporated by reference herein.

Air discharge port 78 has a generally cylindrical shaped passage 128 defining an internal surface 132. Internal surface 132 defines a threaded end 140 for connection to an air exhaust tube 60 which vents the interior of pump body 12 to the atmosphere. The end of internal surface 132 opposite to threaded end 140 forms an outlet valve seat 142. Outlet valve seat 142 faces away from threaded end 140 and is adapted to mate with a poppet valve 144 which is secured to activation mechanism 146. Poppet valve 144 cooperates with outlet valve seat 142 to connect and disconnect the interior of pump body 12 with the outside atmosphere. While air discharge port 78 has been shown and described as being an integral component of discharge housing 116, it is within the scope of the present invention to have individual components define exhaust port 78, as is shown in U.S. Pat. No. 5,358,038, already incorporated by reference herein.

With further reference to FIGS. 3–6, activation mechanism 146 comprises a bracket 152, an activation arm 154, and a magnet holder 156. Bracket 152 is fixedly secured to discharge housing 16 by a plurality of bolts 158. Pivotally attached to bracket 152 is activation arm 154. Activation arm 154 is a generally U-shaped arm which partially encircles dip tube 18. Activation arm 154 is adapted along the length of the two leg sections for mounting poppet valve 144 of air discharge port 78, for mounting an activation pin 160 of air inlet valve 100, and for locating magnet holder 156. Activation pin 160 is mounted to one leg of activation arm 154. Activation pin 160 is mounted to one leg of activation arm 154 such that activation pin 160 contacts ball 118 and lifts ball 118 off of inlet valve seat 116 opening air inlet valve 100 when activation arm 154 is pivoted upward as shown in FIG. 6. When activation arm 154 is pivoted downward as shown in FIG. 4, ball 118 is again free to locate in inlet valve seat 116 thus closing air inlet valve 100. Poppet valve 144 comprises a spherically shaped poppet 162 and a cylindrical stem 164. Cylindrical stem 164 is inserted through a hole in one of the legs of activation arm 154 opposite to the leg which mounts activation pin 160 and is secured to activation arm 154 by means known well in the art such that poppet 162 is allowed to move perpendicular with respect to activation arm 154. Upon upward movement of activation arm 154 as shown in FIG. 6, poppet 162 engages outlet valve seat 142 and closes air discharge port 78. When activation arm 154 is pivoted downward as shown in FIG. 4, poppet 162 is disengaged from outlet valve seat 142 and air discharge valve 126 is open.

As will be described herein, a check valve 204 in air inlet tube 58 provides a positive air pressure which applies a closing force upon poppet 162 to assist the closing of air exhaust port 78 upon the opening of air inlet valve 100. This reduces cross over and reduces wear between poppet 162 and outlet valve seat 142. During assembly of pumping system 10, air inlet valve 100 is inserted into discharge housing 16 and adjusted such that poppet 162 contacts outlet valve seat 142 at substantially the same time that activation pin 160 contacts ball 118. This adjustment further insures elimination of any cross over. Once adjusted, air inlet valve 100 is secured in place.

With particular reference to FIGS. 3 and 5, magnet holder 156 is attached to the open end of one of the legs of activation arm 154. Magnet holder 156 receives a second actuating magnet 168. The lower end of magnet holder 156, or the end opposite to magnet 168, is attached to a lost motion device or actuator linkage 170. Magnet 168 is adapted to mate with magnet 82 to keep activation arm 154 in an upward position thus maintaining the discharge mode of pumping system 10 until the weight of float 20 acts to separate the two magnets and switch pumping system 10 into the refill mode. Actuator linkage 170 makes the connection between magnet holder 156 of activation mechanism 146 and float 20. Actuator linkage 170 comprises a bracket 172 which is fixedly attached to the lower end of magnet holder 156 and has a longitudinally extending slot 174. Actuating rod 92 has a U-shaped bend in the upper end thereof such that actuating rod 92 extends through slot 174 of bracket 172. Linkage 170 allows relative movement between actuating rod 92 and activation mechanism 146 to allow for the movement of activation arm 154 due to the mutual attraction of magnets 82 and 168 as will be described later herein.

Figure 8:
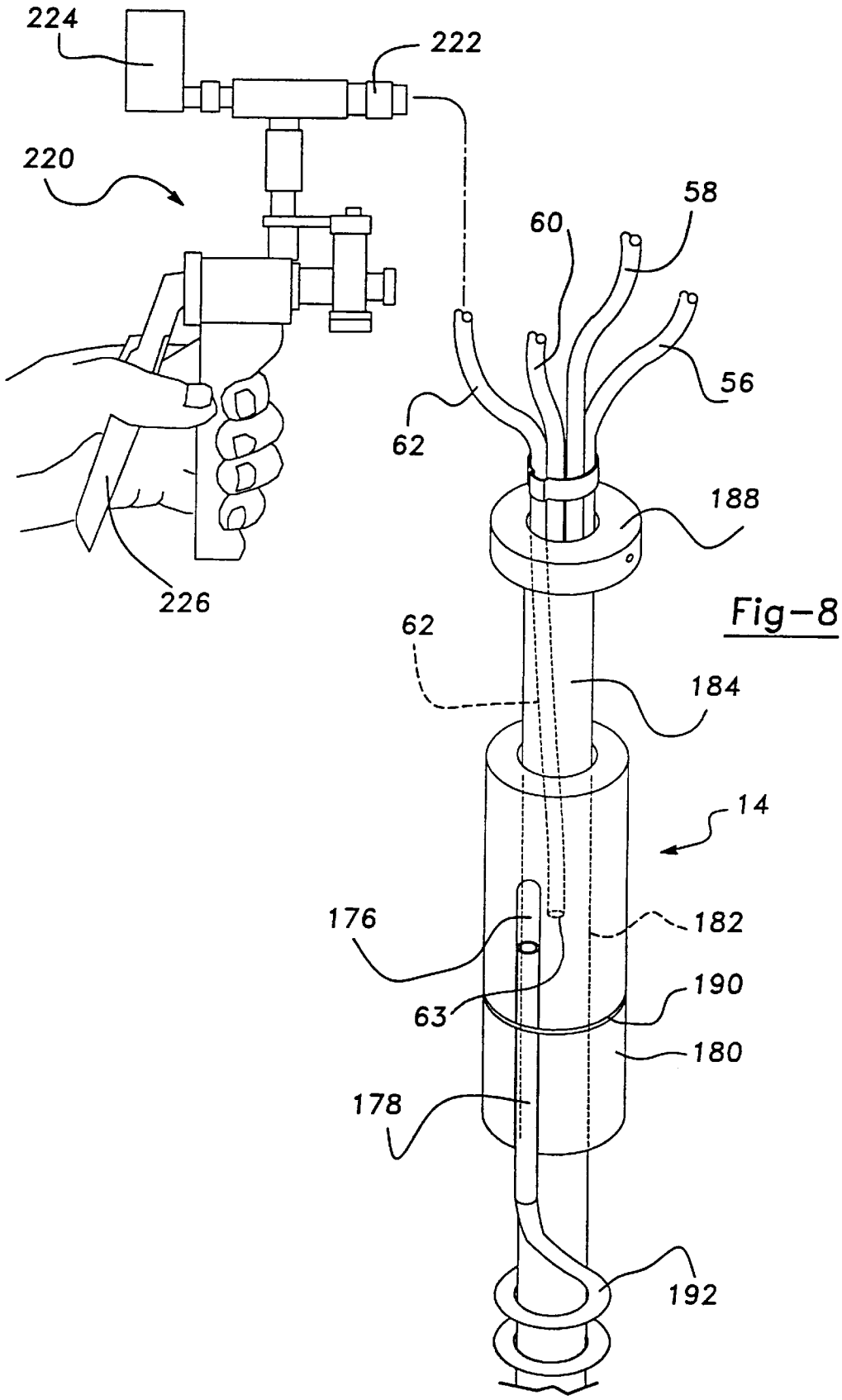
FIG. 8 is a longitudinal cross section of the float and float guide of FIG. 1 in use with a positioning gauge.

The pumping system 10 of the present invention also includes an inlet mechanism 14 which tracks the water/hydrocarbon interface so that variations in the interface level do not result in needless pumping of water or in the inlet being above the top of the hydrocarbon layer. As best seen in FIGS. 1 and 8, the inlet mechanism 14 includes a cylindrically shaped float 180 having a cylindrical passage 182 axially located along the interior of float 180. An axial float guide 184 passes through the cylindrical passage 182 of float 180 and connects at its bottom end to an inlet manifold 186 and at its top end to a radial float guide 188. Radial float guide 184 ensures unimpeded annular translation of float 180 within the well by radially locating float guide 188. Inlet manifold 186 and radial float guide 188 are thus sized to maintain radial alignment of float guide 188 and float 180. A depression 176 is formed in the exterior surface of float 180. The depression 176 is sized to receive inlet tube 178, which is fastened to the exterior of the float 180 by a ring 190. Inlet tube 178 includes a first end for receiving fluids and a second end connected to tubular coil 192. Tubular coil 192 encircles the axial float guide 184.

As best seen in FIGS. 9 and 10, the opposite end of the tubular coil 192 connects to inlet manifold 186 via a barb 194 and is clamped to barb 194 by clamps 193. The barb 194 engages threads 195 formed in inlet manifold 186 in order to attach thereto. The barb 194 includes a weep hole 196 to allow fluid to enter the inlet manifold 186 at the barb 194 as well as through inlet tube 176. A screen (not shown) provides a filter for the fluid entering the inlet manifold 186 through the weep hole 196. The inlet manifold 186 includes a fluid passage 198 to enable fluid entering the tubular coil 192 through the inlet tube 178 and the weep hole 196 to flow through inlet manifold 186, into nipple 200, through the discharge housing 16, and into the pump body 12. Inlet manifold 186 includes a check ball 208 which cooperates with valve seat 202 to eliminate back flow from the nipple 200 into the tubular coil 192. Nipple 200 connects to inlet manifold 186 by engaging threads 197 and similarly engages a fluid passage 199, shown in FIG. 7, formed in discharge housing 16. Nipple 200 also provides a rigid mounting post to interconnect discharge housing 16 with the inlet manifold 186 and to support inlet manifold 186, float guide 184, and float 180. Inlet manifold 186 also includes a passage (not shown) through which the air inlet tube 58, air exhaust tube 60, and discharge tube 56 each may pass. The tubes 56, 58, and 60 pass through the passage of inlet manifold 186 and through the interior of the axial float guide 184. The tubes exit the top of radial float guide 188 (FIGS. 1 and 8) in order to provide a surface connection with the air supply and exhaust tubes 58 and 60, respectively, and discharge tube 56.

The pump air inlet tube 58 also includes a check valve 204 and a restrictor 206, to be described further herein.

The operation of pumping system 10 begins with the insertion of pumping system within a well (not shown). Air inlet tube 58 attaches air inlet valve 100 to a source of compressed air. Air exhaust tube 60 attaches air discharge valve 126 to the outside atmosphere. Discharge tube 56 attaches discharge housing 16 to a surface discharge line (not shown).

Position tube 62 provides a means for placing the pump at a predetermined depth below the surface of the liquid within the well. As shown in FIG. 8, the lower end 63 of position tube 62 is inserted a predetermined distance into axial float guide 184. The lower end 63 of position tube 62 is placed within axial float guide 184 in order to centralize the opening for the inlet tube 176 along axial float guide 184 so that the float 180 can travel approximately equally both upwards and downwards in accordance with the level of the hydrocarbon/water interface. Thus, when the lower end 63 of position tube 62 is placed in a predetermined location with respect to the surface of the fluid within the well, the float 180 and associated inlet tube 178 are correspondingly positioned in proximity to the center of travel. In a preferred configuration, the pumping system 10 is positioned within the well so that the lower end of the position tube is approximately six inches below the upper surface of the fluid, whether hydrocarbon or water, within the well.

In order to obtain such positioning, a positioner pump 220 is connected to the upper end of position tube 62. The pump 220 includes a fitting 222 which attaches to the position tube 62. Opposite the fitting 222 is a pressure gauge 224 which measures the air pressure within the position tube 62. The air pressure varies in accordance with the depth of the lower end 63 of the position tube 62. The pump 220 also includes a hand lever 226 which the operator uses to force air downward into position tube 62.

In operation, the operator pumps hand lever 226, which causes air to be forced down into position tube 62. The operator squeezes lever 226 in order to completely purge position tube 62 of all fluids so that only air remains within position tube 62. When all fluid has been purged, the pressure gauge 224 will indicate the depth that the lower end 63 of position tube 62 is below the upper surface of the fluid within the well. The operator may then adjust the level of pumping system 10 in order to place the lower end of position tube 62 a predetermined depth below the upper surface of the fluid within the well.

Upon insertion into the well, pumping system 10 is in the pump start up mode. Fluid from the well enters the interior of pump body 12 through the weep hold 196 and the inlet tube 178 to flood the inlet manifold 186. This pump start up mode eliminates the need to prime the pumping system 10 and eliminates any usual hydrostatic head conditions. Fluid entering the weep hole 196 also causes the pump to cycle every three to four minutes, providing the user with audible feedback that the pumping system 10 is operational. During the pump start up cycle, the pump may take in both water and hydrocarbon fluid. As will be explained further herein, water will be expelled through the bottom of the pump. As the liquid travels down the tubular coil 192 and into the inlet manifold 186, check ball 208 will rise from its seat 202 due to a pressure differential, enabling fluid to flow through the fluid passage 198 and nipple 200 into the pump body 12.

Following the pump start up cycle, the pumping system 10 enters a refill cycle. During the refill cycle, water and hydrocarbon enter the pump through the inlet tube 178 and the weep hole 196 so that pump body 12 fills with water and hydrocarbon. Because the water is heavier than the hydrocarbon, and they are not miscible, the water and hydrocarbon separate, and the water settles to the bottom of pump body 12. The water in the bottom of pump body 12 cause upper check ball 40, which has a specific gravity less than water and greater than the hydrocarbon to be removed from the well, to rise up off of valve seat 44. Similarly, lower check ball 52, which has a specific gravity less than water, rises up towards valve seat 54. Spring loaded check valve 28, preset to open at 30 psi, provides a seal which prevents fluid from entering dip tube 18 from pump body 12, and lower check ball 52 provides a seal which prevents water surrounding the lower section of the pumping system 10 from entering the pump body 12.

As the pump body 12 fills, float 20 continues to rise until contact is made with upper stop 98 which is fixed to actuating rod 92. This contact with upper stop 98 begins to move actuating rod 92 upward through slot 174 of bracket 172. Continued upward movement of float 20 will then begin to pivot activation arm 154. As activation arm 154 continues to pivot, poppet 162 of poppet valve 144 will come into contact with outlet valve seat 142, closing air outlet passage 78. At substantially the same time that poppet 162 contacts outlet valve seat 142, activation pin 160 of activation mechanism 146 contacts ball 118, lifting ball 118 off of inlet valve seat 116 and providing compressed air into the interior of pump body 12. The pressurized air in air inlet tube 58 between check valve 204 and air inlet valve 100 is released when ball 118 lifts off inlet valve seat 116. This release pressure causes poppet 162 of poppet valve to forcibly seal against outlet valve seat 142. This eliminates cross over in the pumping system 10. Poppet 162 and stem 164 are designed to permit continued pivotal movement of activation arm 154 after poppet 162 contacts outlet valve seat 142. In addition, the lever arm effect of activation arm 154 significantly increases the load exerted by the buoyancy of float 20 thus insuring the sealing of air discharge valve 126. Once activation arm 154 reaches this position, magnet 168 and magnet 82 are mutually attracted causing a magnetic locking which holds activation arm 154 in the upward position. Magnets 168 and 82 are allowed to snap together due to the movement of bracket 172 with respect to actuating rod 92 as actuating rod 92 moves within longitudinally extending slot 174.

When activation pin 160 lifts ball 118 off of inlet valve seat 116, compressed air enters the interior of pump body 12. As compressed air enters the interior of pump body 12, the water, which naturally separates from the hydrocarbon, is expelled out of the bottom of the pump body 12 by the compressed air. The compressed air creates a pressure which forces the lower check ball 52 downward to enable water to escape from the bottom of the pump body 12 through bottom discharge plate 34. When the water is totally expelled from the pump body 12, upper check ball 40 resultantly sinks downward onto valve seat 44 of bottom discharge plate 34 because it is heavier than the hydrocarbons. This forces the hydrocarbons within the interior of the pump body 12 to open spring loaded check valve, preset to open at 30 psi, into the pump dip tube 18, through discharge tube 56, and up to the surface. The lower check ball 52 has no downward force exerted by compressed air because upper check ball 40 has sealed bottom discharge plate 34. Lower check ball 52, will then be suspended in water and float upward, seating itself on valve seat 54 on the lower section of bottom discharge plate 34. This will prevent any water from entering the pump body 12 from bottom discharge plate 34. Compressed air entering pump body 12 causes check ball 208 to seat on valve seat 202, thereby preventing air from passing from the pump body 12 into tubular coil 192 and out the inlet tube 178 and weep hole 196.

Restrictor 206 in the air supply line 58 reduces the air flow from the air supply (not shown) so that air enters the pump body 12 at a controlled velocity. This will limit the velocity of water expelled around upper check ball 40, minimizing the possibility that the upper check ball 40 may become entrained in the stream, seating the upper check ball 40 on valve seat 44 prematurely, thereby resulting in water being forced through spring loaded check valve 28 and out dip tube 18. Spring loaded check valve 28 is preset to open at a pressure greater than that required to expel water from the pump body 12 in order to prevent water from entering the dip tube 18 while the pump is filling. Spring loaded check valve 28 thus ensures that the pressure required to discharge water from pump body 12 through bottom discharge plate 34 is less than the pressure required to force water through dip tube 18. Once the hydrocarbon has reached upper check ball 40, allowing upper check ball 40 to seat in valve seat 44 of bottom discharge plate 34, the compressed air then forces the hydrocarbon up the dip tube 18 at a pressure sufficient to overcome the threshold pressure of spring loaded check valve 28.

Fluid within pump body 12 is forced up through check housing 26, through relief valve 28, through dip tube 18, through discharge port 74, and through discharge tube 56. Fluid is not allowed to exit pump body 12 other than through check housing 26 due to the operation of air discharge valve 126 and upper check ball 40. Fluid continues to leave pump body 12 and eventually float 20 begins to lower. As float 20 begins to move downward, air inlet valve 100 is held open and air discharge passage 78 is held closed by the magnetic attraction of magnets 82 and 168, holding activation arm 154 in an upward position. As float 20 continues to lower, float 20 will contact lower stop 96 and thus begin to exert a load on the attached magnets 82 and 168 due to the weight of float 20 reacting through actuating rod 92. When the level of fluid within pump body 12 lowers to the point that the weight of float 20 supported by actuating rod 92 exceeds the load necessary to separate magnets 82 and 168, activation arm 154 pivots downward and closes air inlet valve 100 and opens air discharge passage 78. When air inlet valve 100 closes, spring loaded check valve 28 also closes because the pressure drops below spring loaded check valve 28 threshold pressure. This prevents fluid from traveling back into pump body 12 from dip tube 18. In addition, when air inlet valve 100 closes, check valve 204 closes, causing a positive pressure in air supply tube 58 between air inlet valve 100 and check valve 204. This positive pressure prevents fluid from entering air inlet valve 100 and air supply tube 58 when air inlet valve 100 first opens or in the event of loss of air pressure supply source. Downward movement of float 20 is limited by lower stop 94 on dip tube 18. Pumping system 10 will then begin another cycle. This pump cycling will continue as long as compressed air is provided to air inlet valve 100 and fluid is present in the well surrounding pumping system 10.

With reference to FIGS. 11 and 12, an additional feature associated with the present invention is a screening kit which enables the operator to determine whether the hydrocarbon within the well has a viscosity and specific gravity within predetermined ranges to enable satisfactory operation of the pump system 10. If the hydrocarbon has a viscosity above a predetermined maximum, the hydrocarbon will not flow into the pump. Therefore, in order to inexpensively perform a viscosity test, a viscosity tester 230 can be provided to the user. The viscosity tester is a generally shallow dish having an orifice 232 formed in the bottom therein. In order to test the viscosity of the hydrocarbons, a small sample of the hydrocarbons is removed from the well and placed in the dish up to a predetermined fill line 234. Preferably, the liquid is placed in the dish at a temperature substantially the same as the temperature of the hydrocarbons within the well. The hydrocarbons placed in the viscosity tester 230 then drip from the orifice 232, and the operator times the interval between drips. For an orifice of approximately 0.040 inches, fluids having an acceptable viscosity would drip from the orifice 232 at least or greater than one drop per second.

In addition, a specific gravity tester 240 enables the operator to test the specific gravity of the hydrocarbon within the well. The specific gravity tester 240 is a cupped shaped vessel. The operator fills the vessel with the sample of the hydrocarbon taken from the well. The operator then places a ball 242 onto the top of the fluid placed in the specific gravity tester 240. If the ball 242 sinks to the bottom of the specific gravity tester 240, the specific gravity of the hydrocarbon is within an acceptable range. If the ball 242 floats at any level, the specific gravity of the hydrocarbon is less than the ball 242 and the pumping system 10 would not operate sufficiently. The specific gravity of the ball 242 may be varied in accordance with the particular design of the pump. In a preferred embodiment, the ball 242 has a specific gravity of 0.90 so that the pumping system 10 will operate sufficiently with hydrocarbons having a specific gravity of less than 0.90.

It will be understood by one skilled in the art that several features of the foregoing invention, while described with respect to an automatic, float-operated pump, may be implemented in various other pumping configurations. For example, the separator mechanism 22 and inlet mechanism 14 would be equally effective if implemented on pumps having automatically actuated pneumatic or electric timers, sensor actuated electric pumps, mechanical and electrical float operated pumps and the like.

Referring now to FIGS. 13–16, a one-piece manifold assembly 250 is shown. The one-piece manifold assembly 250 is intended to replace the manifold assembly 186 and the discharge housing 16 shown in FIG. 1 when a fixed inlet mechanism is used rather than the floating inlet mechanism 14 shown in FIG. 1. It will be appreciated, however, that the one-piece manifold could also be used with a floating inlet if desired. The use of a fixed inlet in connection with the pump system of the present invention has the advantage of providing a pump which is significantly shorter in overall length, and which can therefore be used in wells in which the fluid level may be relatively shallow, such as possibly 12 inches or less in depth. This is because with the fixed inlet pumping system, the tubular coil 192 and float 180 are not required.

Figure 13:
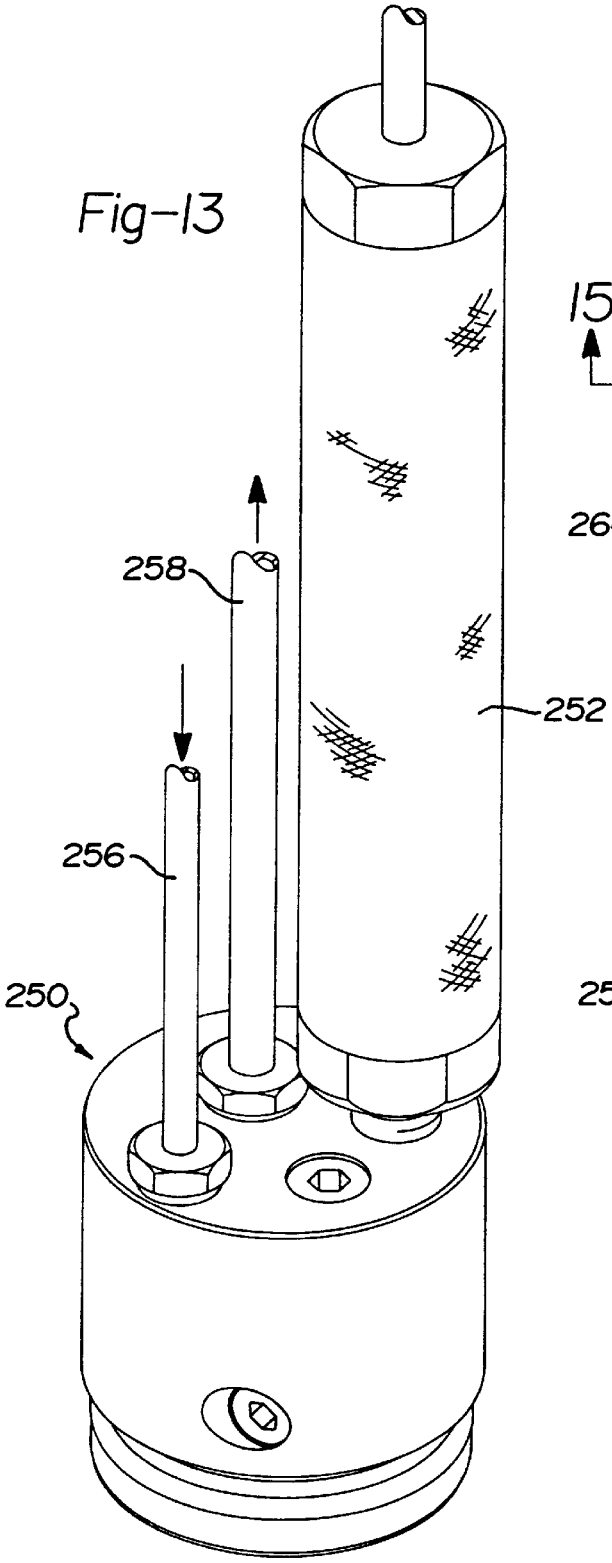
FIG. 13 is a perspective view of a one-piece intake manifold for use with the pumping system of the present invention wherein the pumping system incorporates a fixed inlet rather than a floating inlet.

In FIG. 13, the manifold assembly 250 can be seen to include an inlet screen 252 which circumscribes a positioning tube 254. The positioning tube 254 is used to position the pumping system at the approximate desired depth in a well bore. An air supply line 256 allows air to be pumped into the pumping system as well as allowing air to be vented therefrom. It will be appreciated that if automatic operation of the pump is desired (i.e., where an external controller/timer is not used), that separate air supply and air exhaust/vent lines will need to be employed. A fluid output tube 258 permits fluid which has entered the pumping system to be pumped therefrom back to a recovery reservoir.

Figure 14:
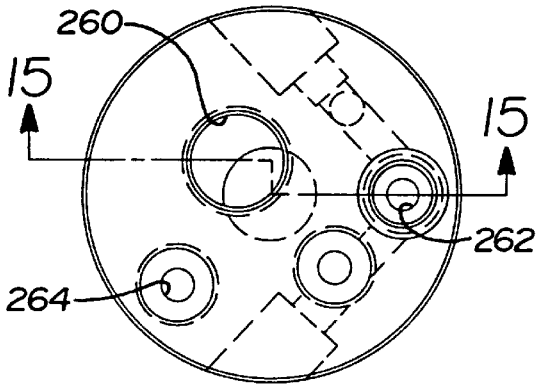
FIG. 14 is a top plan view of the intake manifold of FIG. 13 with the inlet screen omitted.
Figure 15:
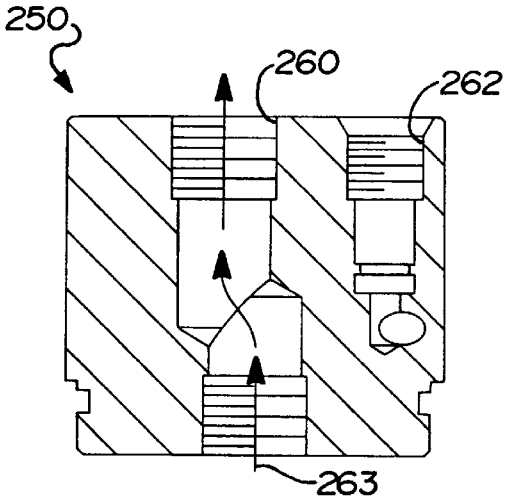
FIG. 15 is a side cross sectional view of the manifold of FIG. 14 in accordance with section line 15—15 in FIG. 14.

FIG. 14 further illustrates a fluid discharge port 260, a fluid inlet port 262 and an air supply port 264. FIG. 15 illustrates the fluid flow path for fluid being pumped out of the pumping system. FIG. 16 illustrates the same "S-shaped passageway that is formed inside the manifold 250 as in FIG. 10. A bore 267 communicates with a chamber 269 in which a check ball 266 is located. The check ball 266 could be replaced with a conventional piston and spring assembly if desired.

Referring now to FIG. 17, there is shown a complete pumping assembly 268 incorporating the one-piece manifold 250. As can be seen, the overall length of the pumping assembly 268 is drastically reduced. This permits the pump to be used in very shallow wells, and even wells having as little as 12 inches or less of fluid. The internal operation of the pumping assembly 268 is otherwise identical to the pump assembly 10 described in connection with FIGS. 1–10.

It will also be appreciated that both the pumping system 10 and the pumping system 268 could easily be adapted with little modification for use with an external controller to provide longer cycle time if desired. This would permit one to extend the time between cycles to allow more time for the fluids to separate inside the pump body such that separation is more complete before the hydrocarbons are expelled from the pump. With an external controller, times as long as one hour between cycles, or even longer, could be set to ensure complete separation of the fluids in the pump.

It will also be appreciated that both of the pumping systems 10 and 268 could be adapted for use with little modification to incorporate a bladder therein. The air used to eject the fluids, in this instance, would then be used to impinge the bladder from either an outer surface of the bladder or an interior thereof to enable the bladder to pump the fluids up through the discharge tube.

While the above detailed description describes the preferred embodiment of the present invention, it should be understood that the present invention is susceptible to modification, variation and alteration without deviating from the scope and fair meaning of the subjoined claims.

What is claimed is:

1. A pneumatic pump which separates a first and second fluid within a well, where the first and second fluid each have a specific gravity and the specific gravity of the second fluid is less than the specific gravity of the first fluid, comprising:

an outer tube forming an outer chamber therein;

an inner tube forming an inner chamber therein, the inner tube disposed within the outer chamber of the outer tube;

an inlet manifold in proximity to a second end of the inner and outer tubes, the manifold having an internal fluid passage with first and second ends the second end of the fluid passage being connected by a second fluid passage to the outer chamber, the inlet manifold having a valve to enable fluid flow in a first direction from the first end of the fluid passage to the outer chamber and inhibiting fluid flow in an opposite direction;

a well float having a floating fluid inlet disposed in proximity to an interface between the first and second fluids and having a specific gravity such that the well float floats in both the first and second fluids and the inlet remains in proximity to the interface between the first and second fluids, the float including the floating fluid inlet formed thereon for receiving at least one of the first and second fluids;

the conduit providing fluid passage between the floating fluid inlet and the first end of the internal fluid passage;

a fluid separator at a first end of the outer tube, the separator defining a fluid passage between the inner and outer chambers, where in a first configuration, the first fluid exits the pump from the outer chamber while the second fluid remains within the outer chamber, and in a second configuration, the first fluid is sealed from entering the pump from an area exterior to the pump and the second fluid may be discharged from the pump; and a discharge housing to exhaust air from the pump to enable entry of fluid into the outer chamber and to introduce air into the pump to enable discharge of fluid from the outer chamber via the inner chamber, the discharge housing also having a fluid passage to communicate fluid from the inner chamber of the pump.

2. The pneumatic pump of claim 1 wherein the discharge housing is disposed in a second end of the outer tube and having a formed therein inlet and outlet air passage which cooperates to enable entry of fluid into the outer chamber and discharge of fluid from the outer chamber via the inner chamber, the discharge housing also having a fluid passage to communicate fluid from the inner chamber of the pump.

3. The pneumatic pump of claim 1 wherein the valve in the inlet manifold comprises a check ball.

4. The pneumatic pump of claim 1 wherein the inlet manifold further comprises a float guide extending from the air inlet manifold and disposed generally within at least one of the first and second fluids, where the well float slidably translates along the float guide.

5. The pneumatic pump of claim 4 wherein the conduit comprises a tubular coil through which the float guide passes, where the coil enables translation of the float along the float guide while communicating fluid between the inlet and the outer chamber.

6. The pneumatic pump of claim 1 wherein the conduit connects to the inlet manifold via a fitting, and a weep hole is formed in proximity to the fitting to facilitate fluid flow through the conduit.

7. The pump of claim 1 wherein the separator further comprises:

a first check ball for sealing the pump exterior from the outer chamber in a first position during the pump discharge mode, the inner and outer chambers communicating when the first check ball is in the first position; and a second check ball for sealing the outer chamber from the pump exterior in a first position during the pump refill mode and during a portion of the pump discharge mode and enabling passage of the first fluid between the outer chamber and the pump exterior in a second position at initiation of the discharge mode.

8. The pump of claim 7 wherein the first and second check ball each has a specific gravity less than the first fluid.

9. The pump of claim 7 wherein the separator comprises a check valve between the inner chamber and first check ball.

10. The pump of claim 1 further comprising a positioning tube having one end disposed within an interior section of the float guide and a second end at a surface level, the positioning conduit being purged with air to create a pressure measured at the second end to determine the position of the first end.

11. A pump for separating a first and second fluid within a well, where the first and second fluid each have a specific gravity and the specific gravity of the second fluid is less than the specific gravity of the first fluid, comprising:

an outer tube forming an outer chamber therein;

an inner tube forming an inner chamber therein, the inner tube disposed within the outer chamber of the outer tube;

a fluid separator at a first end of the outer tube, the separator defining a fluid passage between the inner and outer chambers, where in a first configuration, the first fluid exits the pump from the outer chamber while the second fluid remains within the outer chamber, and in a second configuration, the first fluid is sealed from entering the pump from an area exterior to the pump and the second fluid may be discharged from the pump;

an inlet manifold in proximity to a second end of the inner and outer tubes, the manifold having an internal fluid passage, one end of the fluid passage being connected by a conduit to the outer chamber;

a float guide extending from the air inlet manifold and disposed generally within at least one of the first and second fluids;

a well float slidably disposed upon the float guide and having a fluid inlet disposed thereon which receives the first and second fluids, the well inlet float having a specific gravity less than the specific gravity of the first fluid and greater than the specific gravity of the second fluid;

a conduit for communicating, fluid between the fluid inlet and a second end of the inlet manifold fluid passage so that fluid entering the fluid inlet of the well float passes into the outer chamber;

a discharge housing disposed between the inlet manifold and the second ends of the inner and outer tubes, the discharge housing having a fluid discharge port in communication with the inner chamber of the inner tube;

a gas inlet valve disposed within the discharge housing for selectively admitting in a pump discharge mode and blocking in a pump refill mode a pressurized gas into the outer chamber;

a gas discharge valve disposed within the discharge housing for selectively venting in the pump refill mode and blocking in the pump discharge mode the gas within the outer chamber;

a pump float slidably disposed within the outer chamber, the pump float being buoyant in the liquid wherein the pump float slides from the first end to the second end of the outer tube in response to the level of the liquid in the outer chamber;

actuating means responsive to the position of the pump float for actuating the gas inlet valve and the gas discharge valve between the pump refill mode and the pump discharge mode, wherein the liquid is admitted into the outer chamber during the pump refill mode and the liquid is forced from the outer chamber through the inner chamber during the pump discharge mode, the actuating means comprising:

an actuator rod disposed in the outer chamber, the actuator rod movable by the pump float;

an actuation arm disposed in the outer chamber, the actuation arm pivotably secured at a first end thereof to the pump, the actuation arm movable between an upward position and a downward position, the actuation arm operable to move the gas inlet valve and the gas discharge valve into the pump refill mode when in the downward position and operable to move the gas inlet valve and the gas discharge valve into the pump discharge mode when in the upward position;

a first attracting magnet attached to a second end of the actuation arm;

a second attracting magnet disposed within the pump, the first and second attracting magnets operator to hold the actuation arm in the upward position, the pump float operable to separate the first and second attracting magnets and move the actuation arm to the downward position.

12. The pump of claim 11 wherein the separator further comprises:

a first check ball for sealing the pump exterior from the outer chamber in a first position during the pump discharge mode, the inner and outer chambers communicating when the first check ball is in the first position; and a second check ball for sealing the outer chamber from the pump exterior in a first position during the pump refill mode and during a portion of the pump discharge mode and enabling passage of the first fluid between the outer chamber and the pump exterior in a second position at initiation of the discharge mode.

13. The pump of claim 12 wherein the first and second check ball each has a specific gravity less than the first fluid.

14. The pump of claim 12 wherein the separator further comprises a check valve between the inner chamber and first check ball so that a threshold pressure differential between the inner and outer chambers must be reached before fluid may flow from the outer chamber into the inner chamber.

15. The pump of claim 11 wherein the inlet manifold includes a check valve which prevents fluid from flowing from the outer chamber into the conduit.

16. The pump of claim 11 further comprising a positioning tube having one end disposed within an interior section of the float guide and a second end at a surface level, the positioning conduit being purged with air to create a pressure measured at the second end to determine the position of the first end.

17. The pneumatic pump of claim 11 wherein the conduit comprises a tubular coil through which the float guide passes, where the coil enables translation of the float along the float guide while communicating fluid between the inlet and the outer chamber.

18. The pneumatic pump of claim 11 wherein the conduit connects to the inlet manifold via a fitting, and a weep hole is formed in proximity to the fitting to facilitate fluid flow through the conduit.

19. The pump of claim 11 wherein the gas inlet valve comprises:

an internal surface defining an inlet passageway in communication with the outer chamber, the inlet passageway adapted to attach to a source of compressed gas at a first end and defining an inlet valve seat at a second end;

an inlet check ball disposed within the inlet passageway, the inlet check ball adapted to mate with the inlet valve seat to close the inlet passageway; and an actuation pin fixedly secured to the actuation arm, the actuation pin operable to unseat the inlet check ball from the inlet valve seat when the actuation arm is in the upward position.

20. The pump of claim 11 wherein the gas discharge valve comprises:

an internal surface defining a discharge passageway in communication with the outer chamber and with the outside atmosphere, the discharge passageway defining a discharge valve seat; and a stem secured to the actuation arm, the stem having a discharge check ball disposed thereon, the discharge check ball adapted to mate with the discharge valve seat, the stem operable to seat the discharge check ball within the discharge valve seat when the actuation arm is in the upward position.

21. The pump of claim 11 wherein the actuation arm moves the gas discharge valve into the discharge mode prior to moving the gas inlet valve into the discharge mode.

22. The pump of claim 11 wherein the first inlet means comprises:

a housing fixedly secured to the first end of the outer tube, the housing defining an inlet passageway in communication with the outer chamber and an inlet valve seat; and an inlet check ball disposed within the outer chamber adjacent to the inlet valve seat, the inlet check ball adapted to mate with the inlet valve seat to close the inlet passageway and not allow the liquid to flow from the outer chamber.

23. The pump of claim 11 wherein the second inlet means comprises:

a housing fixedly secured to the first end of the outer tube, the housing defining a discharge passageway in communication with the outer chamber and the inner chamber, the discharge passageway defining a discharge valve seat; and a discharge check ball disposed within the discharge passageway, the discharge check ball adapted to mate with the discharge valve seat to close the discharge passageway and not allow the liquid to flow from the inner chamber to the outer chamber.

24. A pneumatic pump which separates a first fluid and a second fluid from one another within a well, where the first and second fluids each have a specific gravity and a specific gravity of the second fluid is less than the specific gravity of the first fluid, said pump comprising:

an outer tube forming an outer chamber therein;

an inner tube forming an inner chamber therein the inner tube being disposed within the outer chamber of the outer tube;

a fixed fluid inlet disposed in proximity to an interface between the first and second fluids in the well to receive said first and second fluids therethrough, said fluid inlet being in communication with said outer chamber to permit said first and second fluids to drain into said outer chamber;

a fluid separator assembly at a first end of the outer tube, the fluid separator assembly defining a fluid passage between the inner and outer chambers and, wherein in a first configuration, the first fluid exits the pump from the outer chamber while the second fluid remains within the outer chamber, and in a second configuration the first fluid is sealed from entering the pump from an area exterior to the pump and the second fluid may be discharged from the pump through the inner tube; and an air supply member for supplying air into the outer chamber of said pump to force said first fluid out of said outer chamber and said second fluid through said inner chamber and through a discharge member outwardly of said pump; and said air supply member also operating to vent air within said outer tube to atmosphere when the supply of air to said air supply member is removed.

* * * * *